US008134289B2

(12) United States Patent
Morioka et al.

(10) Patent No.: US 8,134,289 B2
(45) Date of Patent: Mar. 13, 2012

(54) ELECTRODE FOR COLD CATHODE TUBE AND COLD CATHODE TUBE EMPLOYING IT

(75) Inventors: Tsutomu Morioka, Yokohama (JP); Toshiaki Suto, Yokohama (JP); Fumihiko Yoshimura, Yokosuka (JP)

(73) Assignees: Kabushiki Kaisha Toshiba, Tokyo (JP); Toshiba Materials Co., Ltd., Yokohama-shi (JP)

( * ) Notice: Subject to any disclaimer, the term of this patent is extended or adjusted under 35 U.S.C. 154(b) by 382 days.

(21) Appl. No.: 12/444,834

(22) PCT Filed: Oct. 10, 2007

(86) PCT No.: PCT/JP2007/001098

§ 371 (c)(1),
(2), (4) Date: Jun. 1, 2009

(87) PCT Pub. No.: WO2008/044334

PCT Pub. Date: Apr. 17, 2008

(65) Prior Publication Data

US 2010/0117514 A1 May 13, 2010

(30) Foreign Application Priority Data

Oct. 13, 2006 (JP) ..... P2006-279958

(51) Int. Cl.
*H01J 1/62* (2006.01)

(52) U.S. Cl. ..... 313/491; 313/492

(58) Field of Classification Search ..... 313/491–492, 313/445, 451, 456, 457, 482
See application file for complete search history.

(56) References Cited

U.S. PATENT DOCUMENTS

2005/0077830 A1 4/2005 Yamashita et al.

FOREIGN PATENT DOCUMENTS

| | | | |
|---|---|---|---|
| JP | 49-109453 | U | 9/1974 |
| JP | 50-21978 | U | 3/1975 |
| JP | 62-229652 | A | 10/1987 |
| JP | 4-272109 | A | 9/1992 |
| JP | 2002-25499 | A | 1/2002 |
| JP | 2004-178875 | A | 6/2004 |
| JP | 2004-192874 | A | 7/2004 |
| JP | 3126624 | U | 10/2006 |
| JP | 2007-066851 | A | 3/2007 |
| WO | WO 2004/017360 | A1 | 2/2004 |

OTHER PUBLICATIONS

British Office Action, dated Nov. 29, 2010, 2 pages.
Jis Z 2501:2000, "Sintered metal materials—Determination of density, oil content and open porosity", Japanese Standards Association (Apr. 2001); 13 pgs.

*Primary Examiner* — Anne Hines
(74) *Attorney, Agent, or Firm* — Foley & Lardner LLP

(57) ABSTRACT

An electrode (1) for cold cathode tube of the present invention includes a cylindrical sidewall portion (2), a bottom portion (3) provided at one end of the cylindrical sidewall portion, and an opening portion (4) provided at the other end of the cylindrical sidewall portion. The electrode is formed of a sintered body of a high melting point metal (W, Nb, Ta, Mo or Re). When an overall length of the electrode is L, an inside diameter of the cylindrical sidewall portion at a position of L/2 is d1, an inside diameter of the bottom portion is d2, and an arc of an inner surface (5) of the cylindrical sidewall portion connecting a portion of the inside diameter d1 and a portion of the inside diameter d2 is R, the electrode satisfies the following condition; L≧6 [mm], d2>d1, R≧20 [mm].

18 Claims, 6 Drawing Sheets

ELECTRODE FOR COLD CATHODE TUBE AND COLD CATHODE TUBE EMPLOYING IT

TECHNICAL FIELD

The present invention relates to an electrode for cold cathode tube, and a cold cathode tube using the same.

BACKGROUND ART

A cold cathode tube has conventionally been used as a backlight of a liquid crystal display device. The cold cathode tube has a longer operating life than a hot cathode tube, so that it is suitably used for a backlight of a liquid crystal display device which can be used over a long period of time in various fields such as a television, a personal computer, a cellular phone and a pinball machine. The cold cathode tube generally takes a configuration in which a pair of electrodes for cold cathode tube formed by coating surfaces of high melting point metal electrodes made of Ni, Mo or the like by an electron emissive material (emitter material) such as $LaB_6$ and $BaAl_2O_4$ are placed opposite to each other inside a glass bulb (glass tube) (refer to Reference 1). Generally, the electrode for cathode tube has a bottomed cylindrical shape.

The conventional bottomed cylindrical electrode is manufactured by performing punching on a plate material (high melting point metal plate material) formed by hot rolling (or cold rolling) an ingot manufactured by a melting method or a sintered body manufactured by a powder metallurgy method. The processing is also called as a drawing when manufacturing a bottomed cylindrical member. For mass-producing the electrode for cold cathode tube, a complicated punching device such as a transfer press and a progressive press is used.

In order to apply the punching, it is required to perform preprocessing such as rolling on the high melting point metal plate material so that its thickness is sufficiently reduced. Further, when the cylindrical electrode is manufactured by the punching, a punching waste is inevitably generated, so that it is difficult to fully use 100% of the plate material (raw material). Tentatively, when the punching waste is reused, there is a need to apply the melting method to manufacture the plate material again. Either of the above becomes a factor for increasing a manufacturing cost for the electrode for cold cathode tube.

As described above, the manufacturing method of the cylindrical electrode applying the punching includes a lot of factors that increase the manufacturing cost, so that it has been difficult to manufacture the cylindrical electrode at a low cost. Further, the high melting point metal plate material manufactured by the melting method or the powder metallurgy method has a relative density of substantially 99% or more and thus has no pore on a surface thereof, so that a surface area thereof is small, which is a drawback. For this reason, when the electron emissive material is applied to the surface, it is only possible to obtain an applied area equal to the surface area.

An electrode for cold cathode tube formed of a sintered body of high melting point metal powder such as W is disclosed in Reference 2. Since this electrode uses the sintered body, it can be manufactured at a lower cost than the electrode applying the punching. However, the shape of the electrode is a cylindrical body with no bottom portion (hollow body), which creates a drawback that a surface area of the electrode is insufficient. When the surface area is insufficient, it is not possible to sufficiently obtain a hollow cathode effect. A partition is provided to eliminate the insufficiency of the surface area in Reference 2, but, it is difficult to manufacture, with such a shape, a small-sized electrode having a diameter of 3 mm or less.

A cold cathode tube is configured by providing a phosphor layer which is excited by ultraviolet light in an inner surface of a glass tube, and by sealing minute amounts of mercury and rare gas in the tube. When a voltage is applied to electrodes provided in both ends of the glass tube, the mercury is evaporated, resulting in emission of ultraviolet light, and the ultraviolet light makes the phosphor layer emit light. When the cold cathode tube is used over a long period of time, a sputtering phenomenon of the electron emissive material (emitter material) and an electrode material is occurred. The mercury inside the tube is taken into a sputtered layer formed by the sputtering phenomenon, resulting that a light emission efficiency and an operating life of the cold cathode tube are decreased.

Reference 3 discloses that a convex portion is provided inside an electrode for cold cathode tube to increase a surface area for suppressing the sputtering phenomenon. The sputtering phenomenon is suppressed by increasing the surface area and the amount of coating of the electron emissive material. However, the electrode disclosed in Reference 3 is not the bottomed one, so that there is a limit in increasing the surface area. Particularly, in a thin electrode whose diameter is 3 mm or less (hollow cylindrical electrode), even if the convex portion is provided therein, there is a limit in increasing the surface area.

In order to improve the above-stated points, Reference 4 and Reference 5 disclose an electrode for cold cathode tube made of a sintered body of W, Nb, Ta, Mo or the like. By using the electrode for cold cathode tube made of the sintered body of W, Nb, Ta, Mo or the like, it is possible to reduce costs and obtain an effect of improvement in the consumption amount of mercury and the like. However, an inner surface of the electrode for cold cathode tube disclosed in Reference 4 and Reference 5 has a cross section of a horseshoe shape in which a bottom portion and an opening portion have the same shape, or of a V shape (or U shape) in which the cross-sectional shape is gradually enlarged from the bottom portion toward the opening portion.

The conventional electrode for cold cathode tube has a problem that it cannot sufficiently suppress the sputtering phenomenon in which an electrode material scatters when ions collide with the electrode during lighting, and deposits on an inside wall of the lamp (cold cathode tube). When the sputtering phenomenon occurs, the mercury inside the cold cathode tube is taken up, and thus is not usable for discharge. Accordingly, when lighting for a long period of time, almost all of the mercury inside the tube is taken into a sputtered layer, which extremely lowers brightness of the lamp, resulting that the lamp reaches the end of its operating life. Therefore, if the sputtering phenomenon can be suppressed, the consumption of mercury can be reduced, which enables to realize a longer operating life even with the same amount of the sealed mercury.

Regarding the above-stated point, the conventional electrode for cold cathode tube having a cross section of a horseshoe shape or a V (U) shape cannot sufficiently suppress the sputtering phenomenon. Further, the electrode for cold cathode tube is used in a state in which a lead terminal is joined thereto. The electrode for cold cathode tube (sintered body electrode) disclosed in Reference 4 and Reference 5 has a thicker wall thickness at the bottom portion side, so that it is inferior in weldability of the lead terminal, which is a drawback.

Reference 1: JP-A 62-229652
Reference 2: JP-A 04-272109
Reference 3: JP-A 2002-025499
Reference 4: JP-A 2004-178875
Reference 5: JP-A 2004-192874

DISCLOSURE OF THE INVENTION

It is an object of the present invention to provide an electrode for cold cathode tube capable of enabling a long operating life of a cold cathode tube by suppressing a consumption amount of mercury inside the cold cathode tube, and a cold cathode tube using such an electrode. It is another object of the present invention to provide an electrode for cold cathode tube having an improved weldability of a lead terminal, and a cold cathode tube using such an electrode.

An electrode for cold cathode tube according to an aspect of the present invention includes: a cylindrical sidewall portion; a bottom portion provided at one end of the cylindrical sidewall portion; and an opening portion provided at the other end of the cylindrical sidewall portion, in which the electrode is formed of a sintered body of a simple substance of a metal selected from tungsten, niobium, tantalum, molybdenum and rhenium, or an alloy containing the metal, and the electrode satisfies $L \geqq 6$ [mm], $d2 > d1$, $R \geqq 20$ [mm], where L is an overall length of the electrode with respect to an axial direction of the cylindrical sidewall portion, d1 is an inside diameter of the cylindrical sidewall portion at a portion of ½ of the overall length L (L/2), d2 is an inside diameter of the bottom portion, and R is a radius of curvature an arc of an inner surface of the cylindrical sidewall portion connecting a portion of the inside diameter d1 and a portion of the inside diameter d2.

An electrode for cold cathode tube according to another aspect of the present invention includes: a cylindrical sidewall portion; a bottom portion provided at one end of the cylindrical sidewall portion; and an opening portion provided at the other end of the cylindrical sidewall portion, in which the electrode is formed of a sintered body of a simple substance of a metal selected from tungsten, niobium, tantalum, molybdenum and rhenium, or an alloy containing the metal, and the electrode satisfies $L \geqq 6$ [mm], $t1 > t2$, $R \geqq 20$ [mm], where L is an overall length of the electrode with respect to an axial direction of the cylindrical sidewall portion, t1 is a wall thickness at a portion of ½ of the overall length L (L/2), d2 is an inside diameter of the bottom portion, t2 is a wall thickness of the cylindrical sidewall portion at the portion of the inside diameter d2, and R is a radius of curvature of an arc of an inner surface of the cylindrical sidewall portion connecting an inside diameter portion of the cylindrical sidewall portion at the portion of L/2 and an inside diameter portion of the bottom portion.

A cold cathode tube according to an aspect of the present invention includes: a tubular translucent bulb in which a discharge medium is sealed; a phosphor layer provided on an inner wall surface of the tubular translucent bulb; and a pair of electrodes each formed of the electrode for cold cathode tube according to the aspect of the present invention and disposed in both end portions of the tubular translucent bulb.

EXPLANATION OF CODES

1, 11 . . . electrode for cold cathode tube, 2 . . . cylindrical sidewall portion, 3 . . . bottom portion, 4 . . . opening portion, 5 . . . inner surface of sidewall portion, 6 . . . R-chamfered portion, 7 . . . C-chamfered portion, 21 . . . cold cathode tube, 22 . . . phosphor layer, 23 . . . tubular translucent bulb, 24 . . . lead terminal.

BEST MODE FOR IMPLEMENTING THE INVENTION

Figure 1:
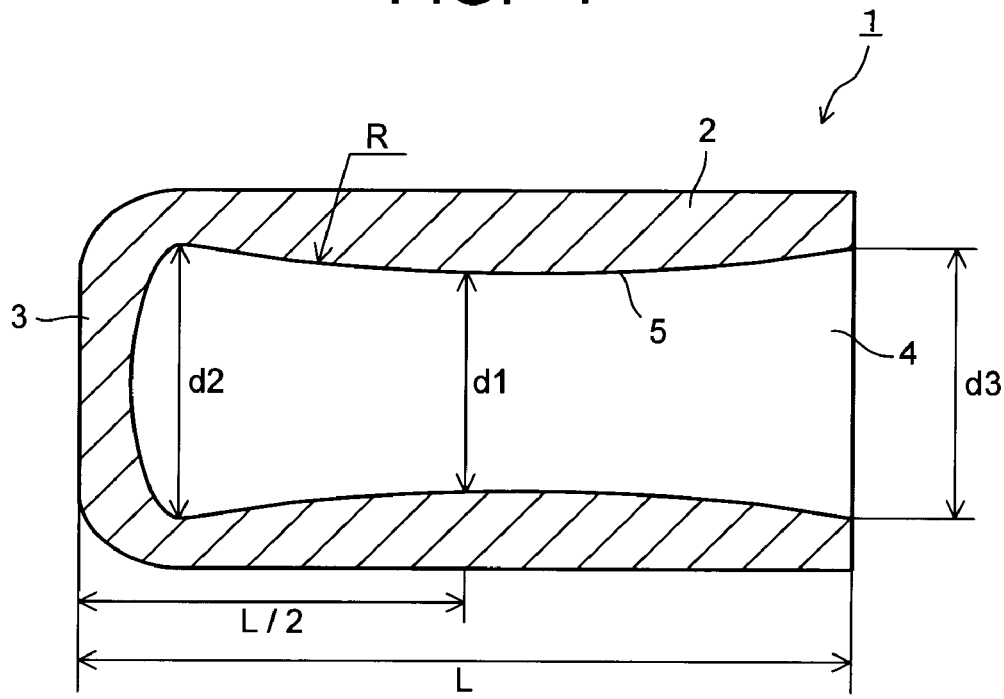
FIG. 1 is a sectional view showing an electrode for cold cathode tube according to a first embodiment of the present invention.

Hereinafter, embodiments for carrying out the present invention will be descried. FIG. 1 shows a configuration of an electrode for cold cathode tube according to a first embodiment of the present invention. An electrode 1 for cold cathode tube shown in FIG. 1 has a bottomed cylindrical shape and includes a cylindrical sidewall portion 2, a bottom portion 3 provided at one end of the sidewall portion 2, and an opening portion 4 provided at the other end of the sidewall portion 2. The sidewall portion 2 has an inner surface 5.

The electrode 1 for cold cathode tube shown in FIG. 1 is made of a sintered body of a simple substance of a high melting point metal selected from tungsten (W), niobium (Nb), tantalum (Ta), molybdenum (Mo) and rhenium (Re), or an alloy containing the high melting point metal. For the alloy constituting the sintered body, an alloy containing two kinds or more of the aforementioned high melting point metals or an alloy containing the aforementioned high melting point metal as its main component, can be cited.

For example, as an alloy suitably applied to the electrode 1 for cold cathode tube, a W—Mo alloy, a Re—W alloy, a Ta—Mo alloy or the like can be cited. As disclosed in the aforementioned Reference 2, the alloy may be the one in which an alkaline earth metal oxide, a rare earth element oxide or the like as an electron emissive material and the high melting point metal are mixed. Further, it is possible to add, as a sintering aid, minute amounts (for example, 1 mass % or less) of nickel (Ni), copper (Cu), iron (Fe), phosphor (P) or the like. By adding the sintering aid, the density of sintered body (electrode) can be adjusted.

The sintered body constituting the electrode 1 for cold cathode tube is preferable to have an average crystal grain diameter of 100 μm or less. An aspect ratio of the crystal grain (major axis/minor axis) is preferably 5 or less. For increasing a surface area of the electrode 1, the sintered body is preferable to have a relative density which falls in a range of 80 to 98%, to provide few pores therein. At this time, if the average crystal grain diameter of the sintered body is greater than 100 μM the relative density is likely to become less than 80% and a strength of the sintered body is likely to be lowered. This similarly applies to the aspect ratio of the crystal grain. The average grain diameter of the crystal grain is more preferably set as 50 μM or less, and the aspect ratio is more preferably 3 or less.

As a measuring method of the relative density, a method according to JIS-Z-2501 is applied to measure the density. Note that a reference value when the relative density is 100% indicates a value in which it is set, as a specific gravity of each material, that W is 19.3, Nb is 8.6, Ta is 16.7, Mo is 10.2 and Re is 21.0. When an alloy is used, the above value is applied according to a ratio (weight ratio) of each material.

In the electrode 1 for cold cathode tube of the first embodiment, an overall length L of the electrode 1 with respect to an axial direction of the cylindrical sidewall portion 2 is set to be 6 mm greater (L≧6 mm). When an inside diameter of the cylindrical sidewall portion 2 at a portion of ½ of the overall length L (portion at L/2) and an inside diameter of the bottom portion 3 are respectively set as d1 and d2, a condition of d2>d1 is satisfied. Further, a radius of curvature R of an arc of the inner surface 5 of the cylindrical sidewall portion 2 connecting a portion of the inside diameter d1 and a portion of the inside diameter d2 is set to have a length of 20 mm or greater (R≧20 mm).

With the use of the bottomed cylindrical electrode 1 having such a shape, it is possible to suppress a sputtering phenomenon generated from an inner surface portion of the bottom portion 3. Specifically, when the inside diameter d1 and the inside diameter d2 satisfy the condition of d2>d1, a substantial convex portion is formed on the inner surface 5 of the sidewall portion 2, which reduces a chance that ions reach the inner surface portion of the bottom portion 3. Accordingly, it becomes possible to suppress the sputtering phenomenon generated from the inner surface portion of the bottom portion 3. Note that the inside diameter d2 is supposed to indicate the largest inside diameter in the bottom portion 3.

Further, by setting the overall length L of the bottomed cylindrical electrode 1 to be 6 mm or greater, the surface area of the electrode 1 is increased. Accordingly, it is possible to enhance the function as the electrode 1 for cold cathode tube. At this time, by making the inner surface of the cylindrical sidewall portion 2 of the bottomed cylindrical electrode 1 form a curved surface in which the radius of curvature of the arc has a length of 20 mm or greater, the strength of the electrode 1 can be improved. Specifically, by applying an inner surface shape in which the radius of curvature R of the arc has a length of 20 mm or greater to the cylindrical sidewall portion 2, it becomes possible to maintain the strength of the bottomed cylindrical electrode 1 whose overall length L is as long as 6 mm or greater.

Further, a ratio of the inside diameter d2 of the bottom portion 3 with respect to the inside diameter d1 at the portion of L/2 of the cylindrical sidewall portion 2 (d2/d1) is preferably 1.03 or greater. When the d2/d1 ratio is less than 1.03, the inner surface portion of the bottom portion 3 becomes susceptive to the sputtering phenomenon. The d2/d1 ratio is more preferably set as 1.08 or greater. If the d2/d1 ratio becomes too large in manufacturing the bottomed cylindrical electrode 1, a crack is likely to be generated, so that it is preferable to set the d2/d1 ratio to be 1.20 or less. As described above, the d2/d1 ratio is preferably set to fall within a range of 1.03≦d2/d1≦1.20.

A diameter d3 of the opening portion 4 of the bottomed cylindrical electrode 1 preferably satisfies d3≧d1. By establishing the condition of d3≧d1, it is possible to increase the surface area of the inner surface 5 of the electrode 1. Further, if d3 is less than d1 (d3<d1), it becomes difficult to manufacture the electrode with metal molding. For this reason, in order to obtain a sintered body satisfying d3<d1, special processing (polishing or the like) has to be conducted, which becomes a factor for increasing a manufacturing cost.

Figure 2:
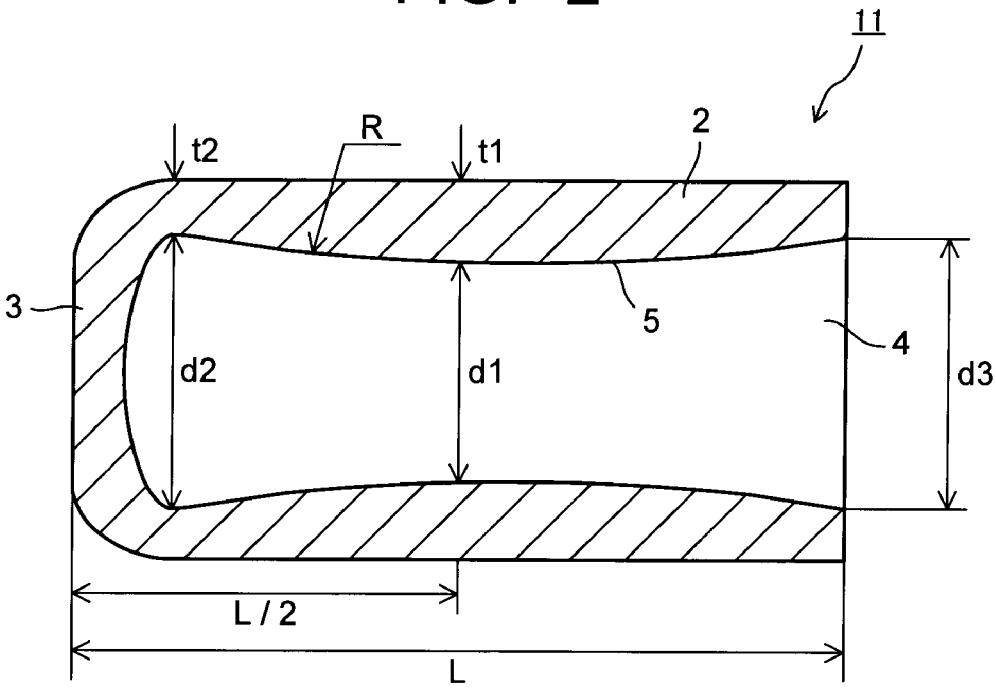
FIG. 2 is a sectional view showing an electrode for cold cathode tube according to a second embodiment of the present invention.

Next, an electrode for cold cathode tube according to a second embodiment of the present invention will be described with reference to FIG. 2. An electrode 11 for cold cathode tube shown in FIG. 2 has a bottomed cylindrical shape and includes: a cylindrical sidewall portion 2; a bottom portion 3 provided at one end of the sidewall portion 2; and an opening portion 4 provided at the other end of the sidewall portion 2, similarly as in the first embodiment. The bottomed cylindrical electrode 11 is made of a sintered body of a simple substance of a high melting point metal selected from W, Nb, Ta, Mo and Re or an alloy containing the high melting point metal. A concrete configuration of the sintered body is the same as that of the first embodiment.

When an inner thickness of the cylindrical sidewall portion 2 at a portion of ½ of an overall length L (portion at L/2) (inner thickness of the sidewall portion 2 corresponding to the inside diameter d1) and a lateral wall thickness of the bottom portion 3 (inner thickness with respect to the lateral of the bottom portion 3 corresponding to the inside diameter d2) are respectively set as t1 and t2, a condition of t1>t2 is satisfied. Further, similarly as in the first embodiment, the overall length L of the electrode 11 is set to be 6 mm or greater (L≧6 mm) and radius of curvature R of an arc of the inner surface 5 of the cylindrical sidewall portion 2 connecting a portion of the inside diameter d1 and a portion of the inside diameter d2 is set to have a length of 20 mm or greater (R≧20 mm).

As described above, by making the inner thickness t1 at the portion of L/2 of the cylindrical sidewall portion 2 thicker than the lateral wall thickness t2 of the bottom portion 3 (t1>t2), it is possible to enhance the weldability of a lead terminal with respect to the electrode 11. A ratio of the inner thickness t1 at the portion of L/2 with respect to the lateral wall thickness t2 of the bottom portion 3 (t1/t2) is preferably set to fall within a range of not less than 1.2 nor more than 6.0 (1.2≦t1/t2≦6.0). When the t1/t2 ratio is less than 1.2 (t1/t2<1.2), a volume of the bottom portion 3 becomes large, which makes it difficult to weld the lead terminal to the electrode 11.

When the t1/t2 ratio becomes greater than 6.0 (t1/t2>6.0), the lateral wall thickness t2 of the bottom portion 3 becomes too thin, which causes a convergence of electric power on that portion at the time of welding, resulting that a generation of spark and a recrystallization of the sintered body become likely to occur. The generation of spark results in a poor weld. Regarding the recrystallization of the sintered body, although there is no problem if the entire of the sintered body is recrystallized, a partial recrystallization is unfavorable because it generates an internal strain. From the above reasons, it is preferable to set the t1/t2 ratio to be 1.2≦t1/t2≦6.0.

Also in the second embodiment, by setting the overall length L of the bottomed cylindrical electrode 11 to be 6 mm or greater, the surface area of the electrode 11 can be increased. At this time, by making the inner surface 5 of the cylindrical sidewall portion 2 of the bottomed cylindrical electrode 11 form a curved surface in which the radius of curvature R of the arc has a length of 20 mm or greater, the strength of the electrode 11 can be improved. Specifically, by applying an inner surface shape in which the radius of curvature R of the arc has a length of 20 mm or greater to the cylindrical sidewall portion 2, it becomes possible to maintain the strength of the bottomed cylindrical electrode 11 whose overall length L is as long as 6 mm or greater.

Figure 3:
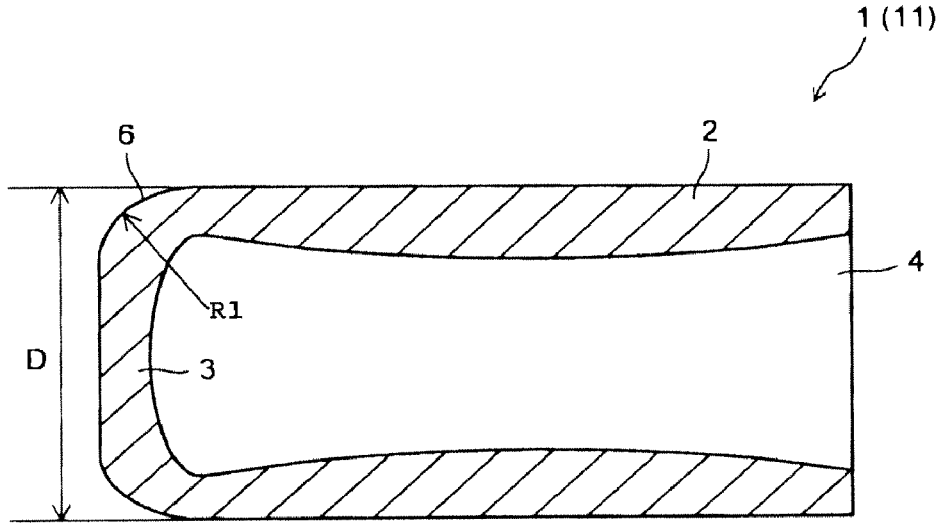
FIG. 3 is a sectional view showing a state in which R-chamfering is performed on a bottom portion of the electrode for cold cathode tube according to the embodiment of the present invention.
Figure 4:
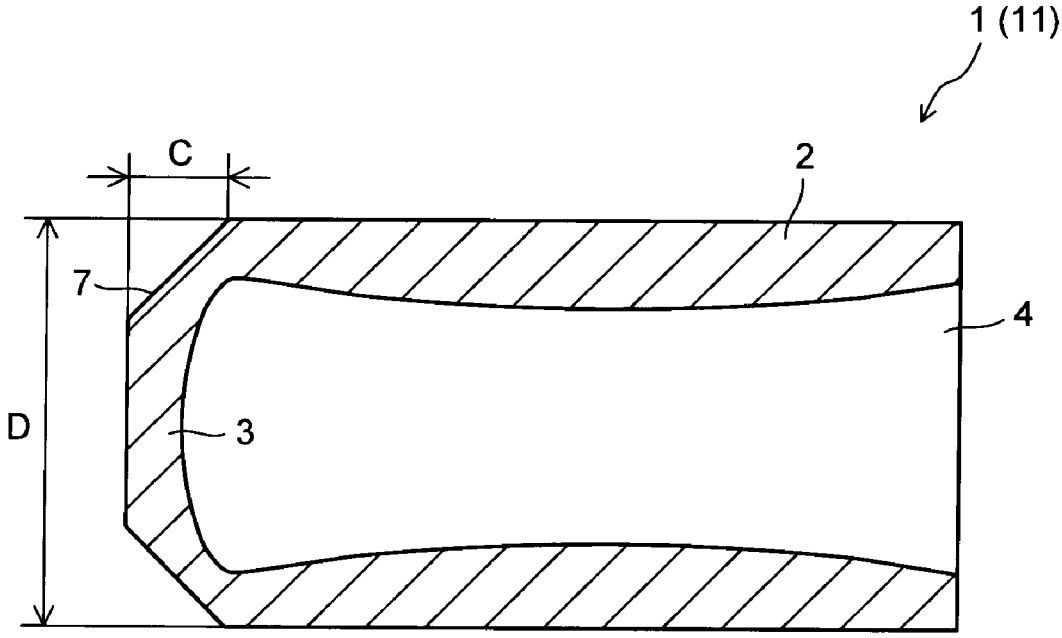
FIG. 4 is a sectional view showing a state in which C-chamfering is performed on the bottom portion of the electrode for cold cathode tube according to the embodiment of the present invention.

When an R-chamfered portion 6 as shown in FIG. 3 or a C-chamfered portion 7 as shown in FIG. 4 is formed on an outer peripheral portion (corner portion) of the bottom portion 3 of the electrodes 1 and 11 for cold cathode tube of the first and second embodiments, a shape thereof is preferably set in which a ratio of a shape R1 [mm] of the R-chamfered portion 6 or a shape C [mm] of the C-chamfered portion 7 with respect to an outside diameter D [mm] of the bottom portion 3 (R1/D or C/D) falls within a range of 0.08 to 0.40.

When the R1/D ratio or the C/D ratio is less than 0.08, the effect of the chamfering cannot be obtained, and power consumption at the time of welding the lead terminal is increased. When the R1/D ratio or the C/D ratio is greater than 0.40, the weldability of the lead terminal is lowered, and an electric power value at the time of welding becomes high. The shape of the chamfered portion may be a curved surface shape or a linear shape. The shape R1 of the R-chamfered portion 6 indicates a radius of curvature [mm] of the R-chamfering. The shape C of the C-chamfered portion 7 indicates a length [mm] of one side which is to be pared off when performing the C-chamfering at 45°.

Figure 5:
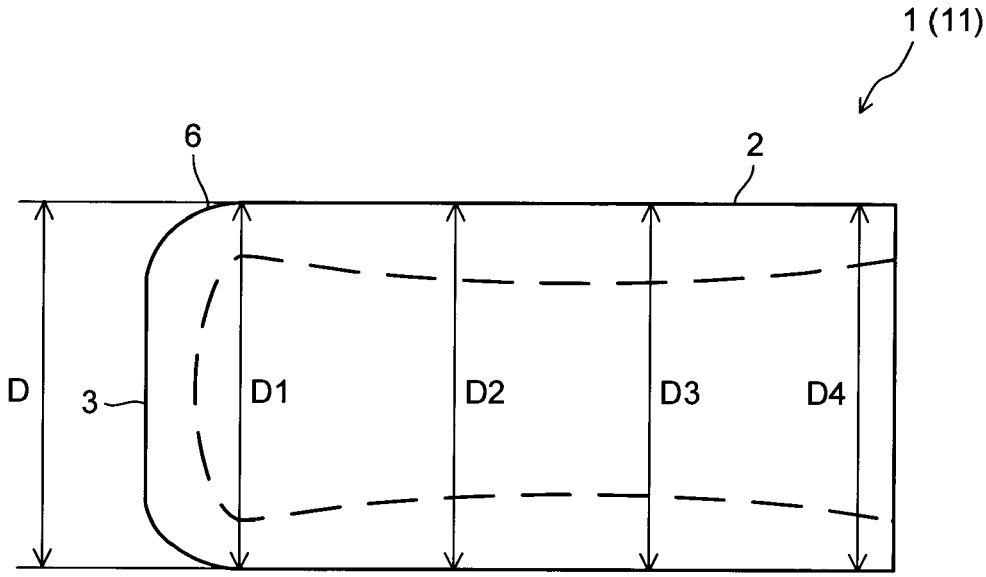
FIG. 5 is a front view showing an outside diameter of the electrode for cold cathode tube according to the embodiment of the present invention.

Further, a deviation of the outside diameter D of the electrodes 1 and 11 for cold cathode tube except the chamfered portions 6 and 7 is preferably 0.01 mm or less. When the deviation of the outside diameter D is greater than 0.01 mm, a welding current value becomes hard to be stable, and a deviation from the center, a contact with a tubular bulb that constitutes the cold cathode tube, and the like are likely to be occurred. In the measurement of the outside diameter D, the overall length L (except the chamfered portions) of the electrodes 1 and 11 is equally divided into four or more, and outside diameters D1 to D4 of the respective parts are measured to determine their average value, as shown in FIG. 5. Differences between the average value and each of the measured values are obtained, and the largest difference is set as "deviation of the outside diameter".

According to the electrode 1 for cold cathode tube of the first embodiment, it is possible to suppress the occurrence of the sputtering phenomenon. According to the electrode 11 foe cold cathode tube of the second embodiment, it is possible to improve the weldability of the lead terminal and the yield of the cold cathode tube. The electrode 1 for cold cathode tube of the first embodiment and the electrode 11 for cold cathode tube of the second embodiment can be combined. By combining them, it becomes possible to obtain the both effects.

When the electrodes 1 and 11 are applied to the cold cathode tube, they are used in a state in which the lead terminals are joined to the bottom portions 3. As the lead terminal, a tungsten bar, a molybdenum bar, an Fe—Ni—Co based alloy bar (for example, KOVAR bar), a Ni—Mn alloy bar or the like is used. Each of the above is joined to the bottom portion 3 of the electrodes 1 and 11 as an electrode terminal by a resistance welding method, a laser welding method or the like. In the bottomed cylindrical electrodes 1 and 11, a bar-shaped lead terminal instead of the linear lead terminal can be used. Accordingly, it becomes possible to surface-bond the joint portions between the electrodes 1 and 11 and the lead terminals, to thereby increase the joining strength. When joining the lead terminals to the electrodes 1 and 11, an insert metal material such as KOVAR can be appropriately used.

The electrodes 1 and 11 for cold cathode tube are coated with an electron emissive material according to need. The coating of the electron emissive material can be carried out by applying various types of methods such as a method of burning the electrode after applying a paste containing the electron emissive material thereto, and a coating method using a sputtering method or a CVD method. The electron emissive material can be coated not only to the outer surfaces of the electrodes 1 and 11 but also to the inner surfaces 5 of the cylindrical sidewall portions 2 and the inner surfaces of the bottom portions 3. As the electron emissive material, a well-known one such as $La_2B_6$ can be applied.

The first and second embodiments are effective for small-sized electrodes 1 and 11 for cold cathode tube having the outside diameter D of 10 mm or less. They are more effective for the electrodes 1 and 11 for cold cathode tube having the outside diameter D of 5 mm or less, and are especially effective for the electrodes having the outside diameter D of 3 mm or less. Since the overall length L of the electrodes 1 and 11 for cold cathode tube is 6 mm or greater, it is possible to increase the brightness of the cold cathode tube configured by using the electrodes. Accordingly, when a backlight or the like is manufactured by using the same-sized cold cathode tubes, it becomes possible to reduce the number of cold cathode tubes required for obtaining the same brightness.

The electrodes 1 and 11 for cold cathode tube according to the first and second embodiments have the bottomed cylindrical shape in which the surface area is increased, so that it becomes possible not only to increase the coated area of the electron emissive material but also to enhance a hollow cathode effect. Further, since the sputtering phenomenon can be suppressed, it becomes possible to prevent the mercury inside the cold cathode tube having the electrodes 1 and 11 from being taken up. Further, the weldability of the lead terminals with respect to the electrodes 1 and 11 is enhanced, which enables to improve the processing yield including welding steps of the lead terminal.

Next, a manufacturing method of the electrodes 1 and 11 for cold cathode tube will be described. First, powder of high melting point metal such as W and Mo is prepared as raw material powder. The high melting point metal powder is preferably high-purity powder whose purity is 99.9% or more, more preferably 99.95% or more. If an impurity amount is greater than 0.1 mass, when the powder is used for the electrodes 1 and 11, the impurity may adversely effect the electrodes. An average particle diameter of the high melting point metal powder is preferably within a range of 1 to 10 μm, and more preferably within a range of 1 to 5 μm. When the average particle diameter of the raw material powder is greater than 10 μm, an average crystal grain diameter of a sintered body is likely to be greater than 100 μm.

The high melting point metal powder is mixed with a binder such as pure water and PVA (polyvinyl alcohol), to thereby perform granulation. At this time, when an alloy having the high melting point metal as its main component is used, a second component is also mixed together. When manufacturing a compound sintered body made of the electron emissive material and the high melting point metal as disclosed in the aforementioned Reference 2, the electron emissive material is also mixed. Next, the binder is added according to need, to thereby perform molding in which the granulated powder is made to be a paste state.

For the molding of the granulated powder, metal molding, a rotary press, injection molding or the like is applied. With the use of such a molding method, a bottomed cylindrical molded body (cup-shaped molded body) is manufactured. At this time, the molded body is manufactured so that the overall length L of the sintered electrode becomes 6 mm or greater. Note that an upper limit of the overall length L of the electrode is not particularly limited, but, the overall length L of the electrode is preferably 10 mm or less in considering the manufacturability (ease of molding, for instance).

Next, the obtained molded body is degreased in a wet hydrogen atmosphere at 800 to 1100° C. Subsequently, the degreased body is burned in a hydrogen atmosphere at a temperature in a range of 1600 to 2300° C., to thereby manufacture a sintered body. For the sintering, various types of sintering methods including pressureless sintering, atmospheric pressure sintering, pressure sintering such as HIP, and the like can be applied.

If the obtained sintered body can be directly used as the electrode, the sintered body just as it is sintered becomes the electrode for cold cathode tube. When a burr or the like is generated, deburring is performed by barrel polishing or the like, and the sintered body is made to be a product (electrode) after being washed according to need. A relative density of the sintered body can be controlled by applying a method of performing sintering while remaining a predetermined amount of binder in the degreased molded body by changing the amount of binder in the molded body or a condition at the time of degreasing, or the like.

In order to obtain the electrode 1 for cold cathode tube of the first embodiment, namely, the electrode 1 for cold cathode tube satisfying the condition d2>d1, it is effective to round or taper a tip portion of the metal mold (bottom portion inside a cup). This is because, when the granulated powder is rounded or tapered, the density of that portion at the time of molding is increased, resulting that the condition d2>d1 is likely to be satisfied. If the rounding is taken as an example, the rounding is preferably carried out in a range of Da/1.5 to Da/3, where Da is an inside diameter of the metal mold.

Figure 6:
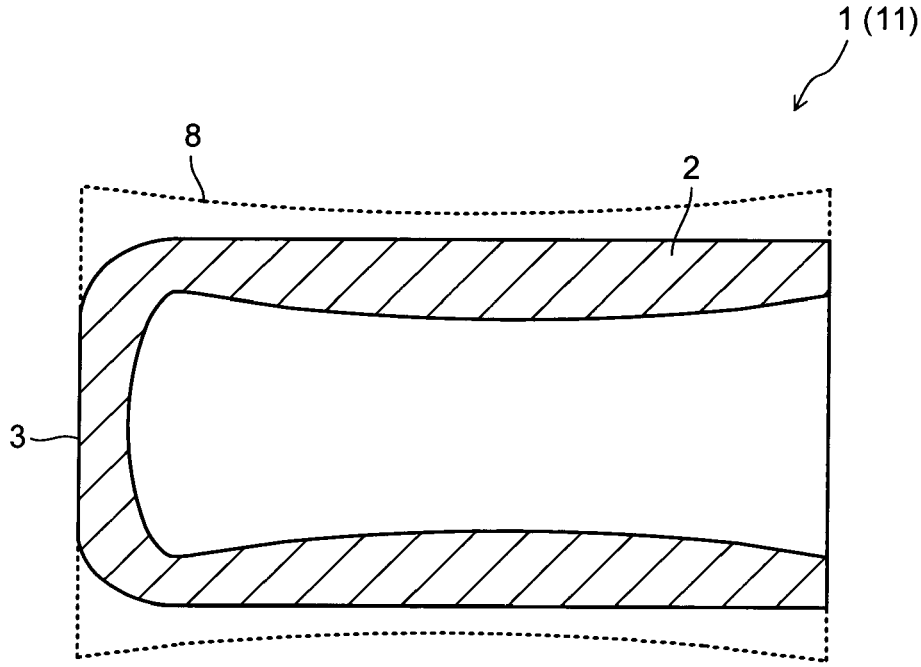
FIG. 6 is a sectional view showing a state in which centerless processing is performed on the electrode for cold cathode tube according to the embodiment of the present invention.

When the chamfered portions 6 and 7 are formed on the electrodes 1 and 11 for cold cathode tube or when the deviation of the outside diameter D of the electrodes 1 and 11 for cold cathode tube is decreased, it is preferable to perform centerless processing on an outer periphery of the sintered body. FIG. 6 shows an example of a portion 8 which is polished by centerless polishing. The molded body shrinks a little when it is sintered, which makes the outer periphery of the sintered body form a gentle concave shape. By performing the centerless polishing on such a sintered body (removing the polished portion 8), it is possible to obtain the electrodes 1 and 11 with the desired shape.

With the use of the centerless polishing, even when the electrodes 1 and 11 are the small-sized ones having the outside diameter D of 10 mm or less, or even 3 mm or less, it is possible to obtain the electrodes 1 and 11 whose outside diameter D is symmetrical (symmetrical with respect to the direction of the overall length L) with good yield. Namely, it is possible to obtain the electrodes 1 and 11 having a small amount of deflection. The amount of deflection indicates, when cross sections (transverse sections) perpendicular to the direction of the overall length L are taken, to what degree the shape of each cross section is close to a perfect round. If the transverse section of the electrode is close to the perfect round, power consumption at the time of welding the electrodes 1 and 11 can be suppressed, which enables the easier welding. Further, it is possible to obtain an effect of reducing the risk of short-circuiting which is occurred when the electrodes 1 and 11 touch the tubular bulb when being incorporated in the cold cathode tube, and so on.

The electrodes 1 and 11 are incorporated in the cold cathode tube after the lead terminals are welded to the bottom portions 3. At this time, by forming the chamfered portions 6 and 7 satisfying the aforementioned condition on the outer periphery of the bottom portions 3 of the electrodes 1 and 11, or by setting the deviation of the outside diameter D of the electrodes 1 and 11 to fall within the aforementioned condition, the weldability of the lead terminals can be improved. Accordingly, it becomes possible to manufacture the electrodes 1 and 11 having the lead terminals with good yield.

Figure 7:
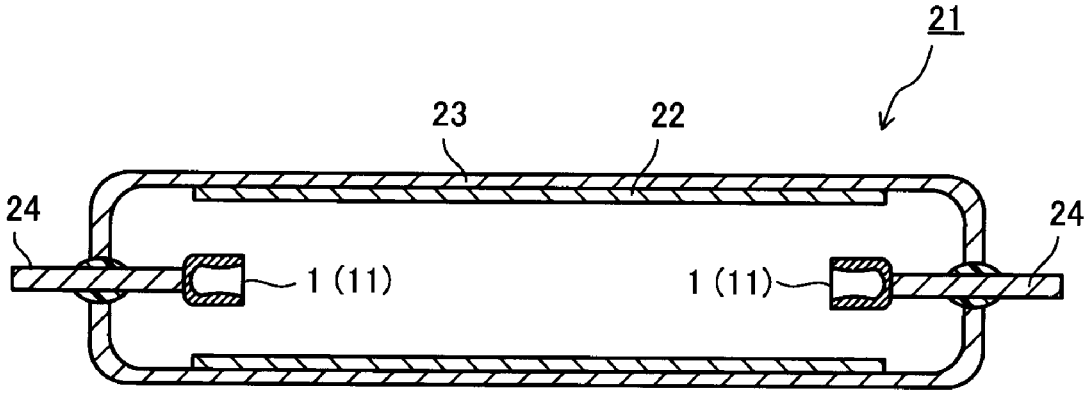
FIG. 7 is a sectional view showing a cold cathode tube according to the embodiment of the present invention.

Next, a cold cathode tube according to an embodiment of the present invention will be described. FIG. 7 is a sectional view showing the cold cathode tube according to the embodiment of the present invention. A cold cathode tube 21 includes a tubular translucent bulb 23 on whose inner wall surface phosphor layers 22 are provided. The tubular translucent bulb 23 is formed of, for example, a glass tube. The electrodes 1 (11) shown in FIG. 1 to FIG. 5 are provided to face each other in both end portions of the tubular translucent bulb 23. The electrodes 1 (11) are provided with the lead terminals 24. A discharge medium is sealed inside the tubular translucent bulb 23.

As the constituent elements of the cold cathode tube 21 except the electrodes 1 (11), that is, as the tubular translucent bulb 23, the phosphor layers 22, and the discharge medium, those conventionally applied to a cold cathode tube of this type, in particular, a cold cathode tube for backlight are usable as they are or are usable with appropriate modification. An example of the discharge medium is rare gas-mercury based gas (the rare gas is argon, neon, xenon, krypton, or a mixture of these). As a phosphor forming the phosphor layers 22, one emitting light when stimulated by ultraviolet light is used.

With the use of the cold cathode tube 21 having the electrodes 1 and 11 for cold cathode tube according to the first and second embodiments, it becomes possible to increase a discharge efficiency, and a light emission efficiency as well, based on an effect of increasing the coated area of the electron emissive material and the hollow cathode effect. Further, since the sputtering phenomenon of the electrodes 1 and 11 can be suppressed, it is possible to prevent the mercury inside the cold cathode tube 21 from being taken up. Accordingly, the cold cathode tube 21 can have a longer operating life. Further, since the weldability of the lead terminals 24 with respect to the electrodes 1 and 11 is enhanced, it is possible to improve the manufacturing yield of the electrodes 1 and 11, and that of the cold cathode tube 21 as well.

Next, concrete examples of the present invention and evaluation results thereof will be described.

EXAMPLES 1 TO 23, REFERENCE EXAMPLE 1, COMPARATIVE EXAMPLES 1 TO 3

Electrodes are manufactured using sintered bodies of high melting point metals under various conditions, and are incorporated in cold cathode tubes for evaluation. An outside diameter D and an overall length L of the sintered body electrodes are respectively 1.7 mm and 7.0 mm, and the d2/d1 ratio is changed. For each electrode, a sintered body having a density of 85 to 95% and manufactured by using high melting point metal powder whose average particle diameter is 1 to 5 μM (impurity amount: 0.1 mass % or less) is applied. Composing materials, manufacturing methods and shapes of the respective electrodes are shown in Table 1. Further, as R of an inner surface of a sidewall portion, radius of curvature R of an arc connecting a portion of d1 and a portion of d2 is determined. The result is shown in Table 1.

The cold cathode tube is manufactured by using a glass tube with an outside diameter of 2.0 mm and an interelectrode distance of 350 mm. A mixed gas composed of mercury and neon/argon is sealed inside the tube. Regarding the operating life of the cold cathode tube, "rare gas discharge mode" in which mercury inside the tube is consumed as a result of the formation of an amalgam with the sputtering material is dominative, so that the operating life can be evaluated by evaluating the consumption amount of mercury. The consumption amount of mercury after 10000 hours is evaluated in this case. The result is shown in Table 1.

As a reference example 1, a similar evaluation is performed also on a cold cathode tube using electrodes whose overall length L is 4.0 mm. Further, as comparative examples 1 to 3, electrodes (outside diameter=1.70 mm, overall length=5.0 mm) manufactured by performing drawing on a high melting point metal plate material are prepared, and the similar evaluation is performed also on cold cathode tubes using these electrodes.

TABLE 1

| | Electrode for cold cathode tube | | | | | | Amount of evaporated |
|---|---|---|---|---|---|---|---|
| | Composition (mass %) | Manufacturing method | L [mm] | d2 [mm] | d2/d1 | R [mm] | mercury [mg] (after 10000 hr) |
| Comparative Example 1 | Mo | Drawing of plate | 5 | 1.5 | 1.0 | ∞ | 0.45 |
| Example 1 | 2%$La_2O_3$—Mo | Sintering | 7 | 1.34 | 1.02 | 31 | 0.50 |
| Example 2 | 2%$La_2O_3$—Mo | Sintering | 7 | 1.34 | 1.03 | 30 | 0.45 |
| Example 3 | 2%$La_2O_3$—Mo | Sintering | 7 | 1.34 | 1.05 | 29 | 0.40 |
| Example 4 | 2%$La_2O_3$—Mo | Sintering | 7 | 1.34 | 1.07 | 27 | 0.35 |
| Example 5 | 2%$La_2O_3$—Mo | Sintering | 7 | 1.34 | 1.09 | 25 | 0.30 |
| Example 6 | 2%$La_2O_3$—Mo | Sintering | 7 | 1.34 | 1.11 | 23 | 0.27 |
| Example 7 | 2%$La_2O_3$—Mo | Sintering | 7 | 1.34 | 1.13 | 21 | 0.24 |
| Example 8 | 2%$La_2O_3$—Mo | Sintering | 8 | 1.34 | 1.11 | 25 | 0.20 |
| Example 9 | 2%$La_2O_3$—Mo | Sintering | 10 | 1.34 | 1.11 | 27 | 0.18 |
| Comparative Example 2 | Nb | Drawing of plate | 5 | 1.5 | 1.0 | ∞ | 0.51 |
| Example 10 | Nb | Sintering | 7 | 1.34 | 1.02 | 31 | 0.58 |
| Example 11 | Nb | Sintering | 7 | 1.34 | 1.03 | 30 | 0.53 |
| Example 12 | Nb | Sintering | 7 | 1.34 | 1.05 | 29 | 0.48 |
| Example 13 | Nb | Sintering | 7 | 1.34 | 1.07 | 27 | 0.43 |
| Example 14 | Nb | Sintering | 7 | 1.34 | 1.09 | 25 | 0.38 |
| Example 15 | Nb | Sintering | 7 | 1.34 | 1.11 | 23 | 0.35 |
| Example 16 | Nb | Sintering | 7 | 1.34 | 1.13 | 21 | 0.32 |
| Comparative Example 3 | Ta | Drawing of plate | 5 | 1.5 | 1.0 | ∞ | 0.55 |
| Example 17 | Ta | Sintering | 7 | 1.34 | 1.02 | 31 | 0.60 |
| Example 18 | Ta | Sintering | 7 | 1.34 | 1.03 | 30 | 0.56 |
| Example 19 | Ta | Sintering | 7 | 1.34 | 1.05 | 29 | 0.52 |
| Example 20 | Ta | Sintering | 7 | 1.34 | 1.07 | 27 | 0.48 |
| Example 21 | Ta | Sintering | 7 | 1.34 | 1.09 | 25 | 0.43 |
| Example 22 | Ta | Sintering | 7 | 1.34 | 1.11 | 23 | 0.40 |
| Example 23 | Ta | Sintering | 7 | 1.34 | 1.13 | 21 | 0.37 |
| Reference Example 1 | 2%$La_2O_3$—Mo | Sintering | 4 | 1.34 | 1.06 | 18 | 0.40 |

As is apparent from Table 1, the cold cathode tube using the electrodes satisfying d2>d1 has the low consumption amount of mercury. In particular, in the cold cathode tube using the electrodes in which d2/d1 is 1.03 or greater, it can be confirmed that the consumption amount of mercury is kept low, and an effect of suppressing the sputtering phenomenon is sufficiently obtained. Accordingly, it becomes possible to extend the operating life of the cold cathode tube.

EXAMPLES 24 TO 41, COMPARATIVE EXAMPLES 4 AND 5

By using an Mo sintered body containing 2 mass % of $La_2O_3$ (d2=1.1 mm, d2/d1=1.08), electrodes each having an outside diameter D of 1.70 mm, overall length L of 7.0 mm, radius of curvature R of arc of inner surface of cylindrical sidewall portion of 25 mm, and wall thickness of bottom portion of 0.3 mm are manufactured. A wall thickness t1 at a portion of L/2 is set as 0.3 mm, and a lateral wall thickness t2 of the bottom portion is changed in various values. The wall thickness t2 is adjusted by a size of metal mold at the time of molding and a polishing amount in the ceterless processing. Composing materials, manufacturing methods and shapes (L, t1, t2/t1 ratio) of each of the electrodes are shown in Table 1.

The welding test is carried out with respect to each of the electrodes. In the welding test, a welding current value at which a KOVAR alloy being an insert metal having a diameter of 1.0 mm and a thickness of 0.1 mm is fully melted when a lead terminal made of Mo is welded under a constant welding voltage of 5.5 V, is measured. Such an experiment is performed 10 times on each of the electrodes, and average values thereof are shown in Table 2 as measured results. As comparative examples, a similar experiment is performed on an Mo cup formed by plate drawing (outside diameter of 1.70 mm and length of 5.0 mm, bottom thickness of 0.2 mm, and lateral wall thickness of 0.1 mm), and an Mo electrode having the t2/t1 ratio which is set as 1.

TABLE 2

| | Electrode for cold cathode tube | | | | | Current value |
|---|---|---|---|---|---|---|
| | Composition (mass %) | Manufacturing method | L [mm] | t1 [mm] | t1/t2 | at which Kovar melts [A] |
| Comparative Example 4 | Mo | Drawing of plate | 5 | 0.1 | 1.0 | 350 |
| Comparative Example 5 | 2%$La_2O_3$—Mo | Sintering | 7 | 0.3 | 1.0 | 500 |
| Example 24 | 2%$La_2O_3$—Mo | Sintering | 7 | 0.3 | 1.05 | 500 |
| Example 25 | 2%$La_2O_3$—Mo | Sintering | 7 | 0.3 | 1.10 | 500 |
| Example 26 | 2%$La_2O_3$—Mo | Sintering | 7 | 0.3 | 1.15 | 490 |
| Example 27 | 2%$La_2O_3$—Mo | Sintering | 7 | 0.3 | 1.20 | 450 |

TABLE 2-continued

| | Electrode for cold cathode tube | | | | | Current value |
|---|---|---|---|---|---|---|
| | Composition (mass %) | Manufacturing method | L [mm] | t1 [mm] | t1/t2 | at which Kovar melts [A] |
| Example 28 | 2%$La_2O_3$—Mo | Sintering | 7 | 0.3 | 1.5 | 420 |
| Example 29 | 2%$La_2O_3$—Mo | Sintering | 7 | 0.3 | 2.0 | 410 |
| Example 30 | 2%$La_2O_3$—Mo | Sintering | 7 | 0.3 | 2.5 | 390 |
| Example 31 | 2%$La_2O_3$—Mo | Sintering | 7 | 0.3 | 3.0 | 370 |
| Example 32 | 2%$La_2O_3$—Mo | Sintering | 7 | 0.3 | 3.5 | 350 |
| Example 33 | 2%$La_2O_3$—Mo | Sintering | 7 | 0.3 | 4.0 | 340 |
| Example 34 | 2%$La_2O_3$—Mo | Sintering | 7 | 0.3 | 4.5 | 330 |
| Example 35 | 2%$La_2O_3$—Mo | Sintering | 7 | 0.3 | 5.0 | 320 |
| Example 36 | 2%$La_2O_3$—Mo | Sintering | 7 | 0.3 | 5.5 | 310 |
| Example 37 | 2%$La_2O_3$—Mo | Sintering | 7 | 0.3 | 6.0 | 300 |
| Example 38 | 2%$La_2O_3$—Mo | Sintering | 7 | 0.3 | 6.05 | 300 (n = 2 spark) |
| Example 39 | 2%$La_2O_3$—Mo | Sintering | 7 | 0.3 | 6.10 | 300 (n = 5 spark) |
| Example 40 | 2%$La_2O_3$—Mo | Sintering | 7 | 0.3 | 6.25 | 300 (n = 7 spark) |
| Example 41 | 2%$La_2O_3$—Mo | Sintering | 7 | 0.3 | 6.5 | spark at all electrodes |

As apparent, when the t1/t2 ratio is set to be 1.20 or greater, the welding current value is particularly lowered, which enables the welding with small power. On the other hand, when the t1/t2 ratio becomes greater than 6.0, the current value is lowered, but, a spark is likely to be generated at the time of welding. In the Table, n indicates the number of electrodes in which the spark is generated at the time of performing welding on 10 electrodes. From the measured results, it can be confirmed that the t1/t2 ratio is preferably set to fall within a range of 1.2 to 6.0.

EXAMPLES 42 TO 61, REFERENCE EXAMPLE 2

Figure 8:
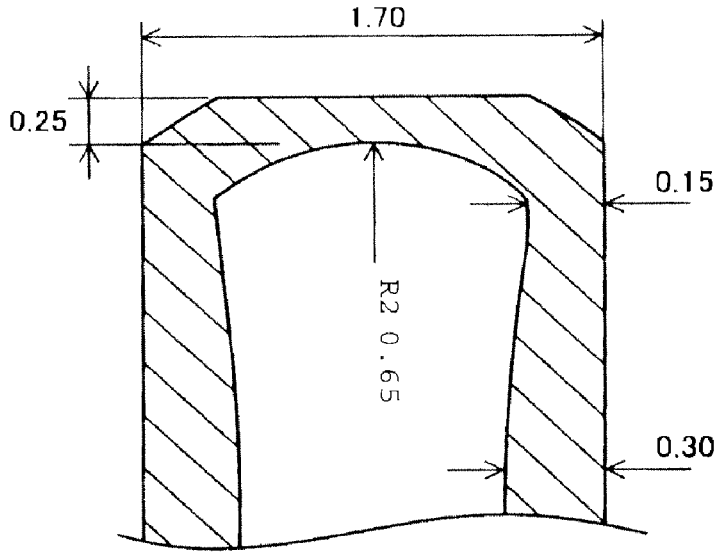
FIG. 8 is a sectional view showing an electrode for cold cathode tube of an example 3.

By using an Mo sintered body containing 2 mass % of $La_2O_3$ (d2=1.1 mm, d2/d1=1.08), electrodes each having a shape as shown in FIG. 8 (outside diameter D=1.7 mm, overall length L=7.0 mm, radius of curvature R of arc of inner surface=25 mm, t2=0.3 mm, t1=0.15 mm, radius of curvature R2 of inner surface of bottom portion=0.65 mm, and thickness of bottom portion=0.25 mm) in which a ratio between a shape C of a C-chamfered portion and the outside diameter D (1.7 mm) of the bottom portion is changed, are manufactured. The welding test is performed on these electrodes. The welding test is conducted in the same manner as in the aforementioned examples.

Besides, the amount of deflection of the electrodes is also measured. The amount of deflection is measured such that the transverse sections in the direction of the overall length L are taken, diameters of three portions or more are arbitrarily measured to determine an average value, and a value having a largest difference with respect to the average value is set as "amount of deflection". The result is shown in Table 3.

TABLE 3

| | Electrode for cold cathode tube | | | | |
|---|---|---|---|---|---|
| | Composition (mass %) | Manufacturing method | C/D | Amount of deflection [mm] | Current value at which Kovar melts [A] |
| Reference Example 2 | 2%$La_2O_3$—Mo | Sintering | 0 | 0.005 | 410 |
| Example 42 | 2%$La_2O_3$—Mo | Sintering | 0.03 | 0.004 | 410 |
| Example 43 | 2%$La_2O_3$—Mo | Sintering | 0.07 | 0.003 | 400 |
| Example 44 | 2%$La_2O_3$—Mo | Sintering | 0.08 | 0.007 | 370 |
| Example 45 | 2%$La_2O_3$—Mo | Sintering | 0.10 | 0.008 | 350 |
| Example 46 | 2%$La_2O_3$—Mo | Sintering | 0.15 | 0.007 | 340 |
| Example 47 | 2%$La_2O_3$—Mo | Sintering | 0.20 | 0.004 | 330 |
| Example 48 | 2%$La_2O_3$—Mo | Sintering | 0.25 | 0.005 | 330 |
| Example 49 | 2%$La_2O_3$—Mo | Sintering | 0.30 | 0.007 | 330 |
| Example 50 | 2%$La_2O_3$—Mo | Sintering | 0.35 | 0.004 | 340 |
| Example 51 | 2%$La_2O_3$—Mo | Sintering | 0.40 | 0.008 | 370 |
| Example 52 | 2%$La_2O_3$—Mo | Sintering | 0.45 | 0.006 | 390 |
| Example 53 | 2%$La_2O_3$—Mo | Sintering | 0.50 | 0.007 | 430 |
| Example 54 | 2%$La_2O_3$—Mo | Sintering | 0.20 | 0.001 | 330 |
| Example 55 | 2%$La_2O_3$—Mo | Sintering | 0.20 | 0.005 | 330 |
| Example 56 | 2%$La_2O_3$—Mo | Sintering | 0.20 | 0.008 | 330 |
| Example 57 | 2%$La_2O_3$—Mo | Sintering | 0.20 | 0.010 | 340 |
| Example 58 | 2%$La_2O_3$—Mo | Sintering | 0.20 | 0.011 | 370 |
| Example 59 | 2%$La_2O_3$—Mo | Sintering | 0.20 | 0.013 | 380 |
| Example 60 | 2%$La_2O_3$—Mo | Sintering | 0.20 | 0.015 | 420 |
| Example 61 | 2%$La_2O_3$—Mo | Sintering | 0.20 | 0.020 | 450 |

As is apparent from Table 3, it can be confirmed that the electrode with its C/D ratio in a range of 0.08 to 0.40 has the small amount of deflection, which enables the welding with small power.

INDUSTRIAL APPLICABILITY

With the use of the electrode for cold cathode tube according to an aspect of the present invention, it is possible to suppress the consumption amount of mercury. Further, it is possible to improve the weldability of the lead terminal. The electrode according to the aspect of the present invention is useful for a cold cathode tube, and by using such an electrode for cold cathode tube, it becomes possible to provide a cold cathode tube having a long operating life with excellent manufacturing yield.

What is claimed is:

1. An electrode for cold cathode tube, comprising:

a cylindrical sidewall portion;

a bottom portion provided at one end of the cylindrical sidewall portion; and an opening portion provided at the other end of the cylindrical sidewall portion, wherein the electrode is formed of a sintered body of a simple substance of a metal selected from tungsten, niobium, tantalum, molybdenum and rhenium, or an alloy containing the metal; and wherein the electrode satisfies L≧6 (mm), d2>d1, R≧20 (mm), where L is an overall length of the electrode with respect to an axial direction of the cylindrical sidewall portion, d1 is an inside diameter of the cylindrical sidewall portion at a portion of ½ of the overall length L d2 is an inside diameter of the bottom portion, and R is a radius of curvature of an arc of an inner surface of the cylindrical sidewall portion connecting a portion of the inside diameter d1 and a portion of the inside diameter d2.

2. The electrode for cold cathode tube according to claim 1, wherein a ratio of the d2 with respect to the d1 is 1.03 or greater.

3. The electrode for cold cathode tube according to claim 1, wherein the electrode satisfies t1>t2, where t1 is a wall thickness of the cylindrical sidewall portion at the portion of L/2 and t2 is a wall thickness of the cylindrical sidewall portion at the portion of the inside diameter d2.

4. The electrode for cold cathode tube according to claim 3, wherein a ratio of the t1 with respect to the t2 is not less than 1.2 nor more than 6.0.

5. The electrode for cold cathode tube according to claim 1, wherein a deviation of an outside diameter of the electrode is 0.01 mm or less.

6. The electrode for cold cathode tube according to claim 1, wherein an outside diameter of the electrode is 3 mm or less.

7. The electrode for cold cathode tube according to claim 1, wherein the bottom portion has a chamfered portion formed by performing C-chamfering or R-chamfering on an outer peripheral corner portion thereof, and when an outside diameter of the bottom portion is D (mm), a shape formed by the C-chamfering is C (mm) and a shape formed by the R-chamfering is R1 (mm), a ratio of the C or the R1 with respect to the D is not less than 0.08 nor more than 0.40.

8. The electrode for cold cathode tube according to claim 7, wherein a deviation of the outside diameter of the electrode except the chamfered portion of the bottom portion is 0.01 mm or less.

9. The electrode for cold cathode tube according to claim 1, wherein the sintered body has an outer peripheral surface on which centerless processing is performed.

10. A cold cathode tube, comprising: a tubular translucent bulb in which a discharge medium is sealed; a phosphor layer provided on an inner wall surface of the tubular translucent bulb; and a pair of electrodes each formed of the electrode for cold cathode tube according to claim 1 and disposed in both end portions of the tubular translucent bulb.

11. An electrode for cold cathode tube, comprising: a cylindrical sidewall portion; a bottom portion provided at one end of the cylindrical sidewall portion; and an opening portion provided at the other end of the cylindrical sidewall portion, wherein the electrode is formed of a sintered body of a simple substance of a metal selected from tungsten, niobium, tantalum, molybdenum and rhenium, or an alloy containing the metal; and wherein the electrode satisfies L≧6 (mm), t1>t2, R≧20 (mm), where L is an overall length of the electrode with respect to an axial direction of the cylindrical sidewall portion, t1 is a wall thickness at a portion of ½ of the overall length L (L/2), d2 is an inside diameter of the bottom portion, t2 is a wall thickness of the cylindrical sidewall portion at the portion of the inside diameter d2, and R is a radius of curvature of an arc of an inner surface of the cylindrical sidewall portion connecting an inside diameter portion of the cylindrical sidewall portion at the portion of L/2 and an inside diameter portion of the bottom portion.

12. The electrode for cold cathode tube according to claim 11, wherein a ratio of the t1 with respect to the t2 is not less than 1.2 nor more than 6.0.

13. The electrode for cold cathode tube according to claim 11, wherein a deviation of an outside diameter of the electrode is 0.01 mm or less.

14. The electrode for cold cathode tube according to claim 11, wherein an outside diameter of the electrode is 3 mm or less.

15. The electrode for cold cathode tube according to claim 11, wherein the bottom portion has a chamfered portion formed by performing C-chamfering or R-chamfering on an outer peripheral corner portion thereof, and when an outside diameter of the bottom portion is D (mm), a shape formed by the C-chamfering is C (mm) and a shape formed by the R-chamfering is R1 (mm), a ratio of the C or the R1 with respect to the D is not less than 0.08 nor more than 0.40.

16. The electrode for cold cathode tube according to claim 15, wherein a deviation of the outside diameter of the electrode except the chamfered portion of the bottom portion is 0.01 mm or less.

17. The electrode for cold cathode tube according to claim 11, wherein the sintered body has an outer peripheral surface on which centerless processing is performed.

18. A cold cathode tube, comprising: a tubular translucent bulb in which a discharge medium is sealed; a phosphor layer provided on an inner wall surface of the tubular translucent bulb; and a pair of electrodes each formed of the electrode for cold cathode tube according to claim 11 and disposed in both end portions of the tubular translucent bulb.

* * * * *